US007309840B1

(12) United States Patent
Lo

(10) Patent No.: US 7,309,840 B1
(45) Date of Patent: Dec. 18, 2007

(54) EMERGENCY STOPPING SAFETY DEVICE OF PAPER SHREDDER

(76) Inventor: Emily Lo, No. 18, Lane 20, Hsin Feng Street, Hsin Chuang City, Taipei Shien (TW)

( * ) Notice: Subject to any disclaimer, the term of this patent is extended or adjusted under 35 U.S.C. 154(b) by 234 days.

(21) Appl. No.: 11/187,330

(22) Filed: Jul. 23, 2005

(51) Int. Cl.
*H01H 1/64* (2006.01)
*H01H 1/66* (2006.01)

(52) U.S. Cl. ..... 200/293; 200/334

(58) Field of Classification Search ..... 200/293, 200/334, 308, 318.2
See application file for complete search history.

(56) References Cited

U.S. PATENT DOCUMENTS 5,186,398 A * 2/1993 Vigneaux, Jr. ..... 241/33
5,593,022 A * 1/1997 Schaeffer et al. ..... 200/308
6,444,932 B1 * 9/2002 Resmalm ..... 200/334
6,483,062 B1 * 11/2002 Herdegen et al. ..... 200/538
6,552,644 B2 * 4/2003 Yu ..... 337/66
6,930,267 B2 * 8/2005 Chou ..... 200/520

* cited by examiner

*Primary Examiner*—K. Richard Lee
(74) *Attorney, Agent, or Firm*—Pro-Techtor Int'l Services

(57) ABSTRACT

An emergency stopping safety device includes an emergency switch and an emergency light. When children accidentally put their fingers into a paper feeder of a paper shredder, the paper shredder can be temporarily disabled by pressing a button of the emergency switch immediately, and the emergency light blinks as warning signal.

3 Claims, 4 Drawing Sheets

EMERGENCY STOPPING SAFETY DEVICE OF PAPER SHREDDER

BACKGROUND OF THE INVENTION (a) Field of the Invention

The invention relates to an emergency stopping safety device of a paper shredder comprising a warning light on the lid of the paper shredder. In the case when children accidentally put their fingers into the paper shredder, pressing the emergency switch thereof can temporarily disable the shredding function. Meanwhile, the warning light blinks as warning signal.

(b) Description of the Prior Art

Most of the traditional paper shredders are not configured with emergency stopping safety devices. When children or infants put their fingers into the paper feeder of the paper shredder by accident or due to curiosity, their fingers would be slashed or cut off in more severe cases.

SUMMARY OF THE INVENTION

The primary object of the invention is to provide a safety device of a paper shredder by adding an emergency switch button to the lid of the paper shredder. When children accidentally put their fingers into the paper feeder of the paper shredder, the emergency switch button can be pressed immediately to temporarily disable the paper shredder for the safety of the children.

DETAILED DESCRIPTION OF THE PREFERRED EMBODIMENTS

Figure 1:
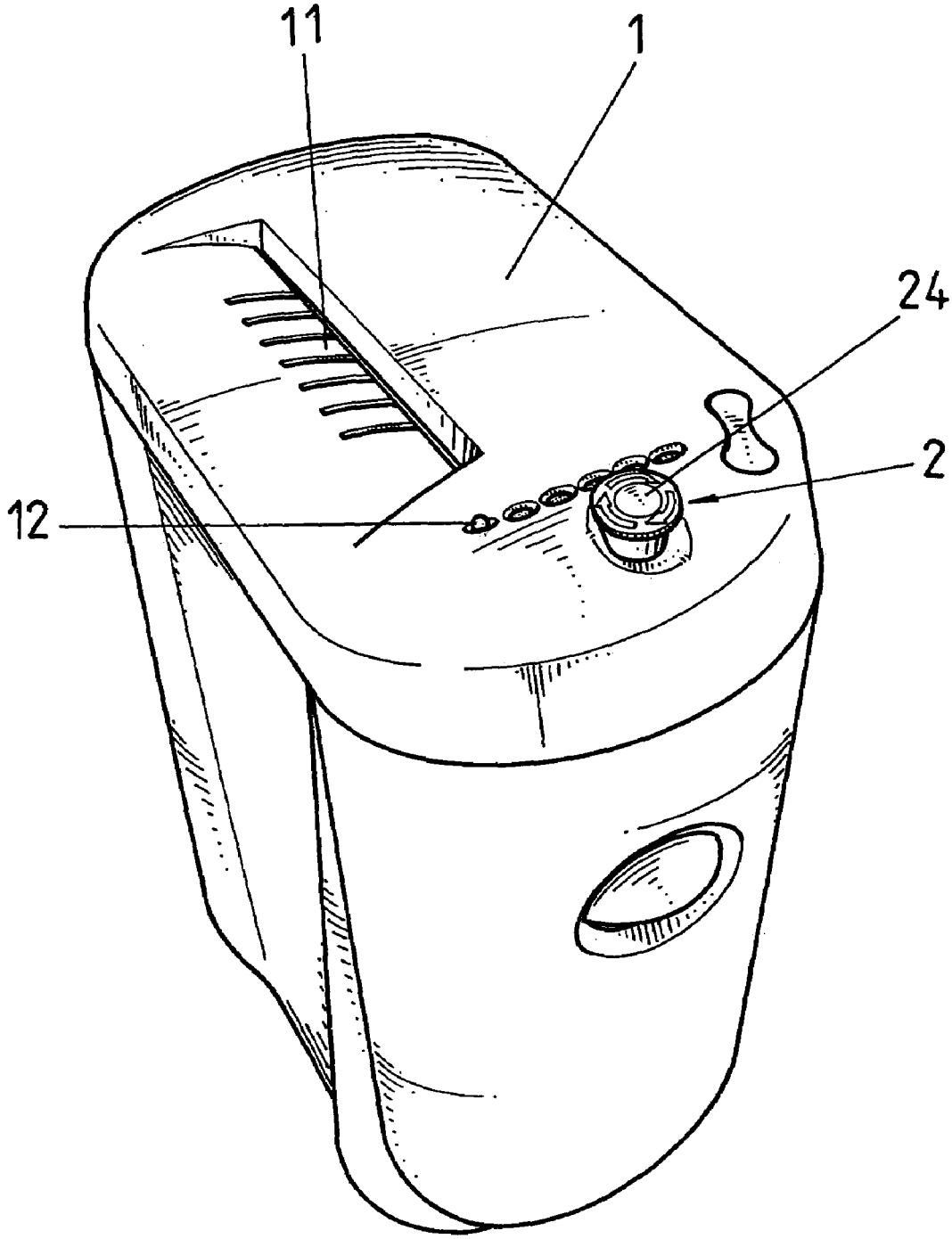
FIG. 1 shows an elevational view according to the invention.
Figure 2:
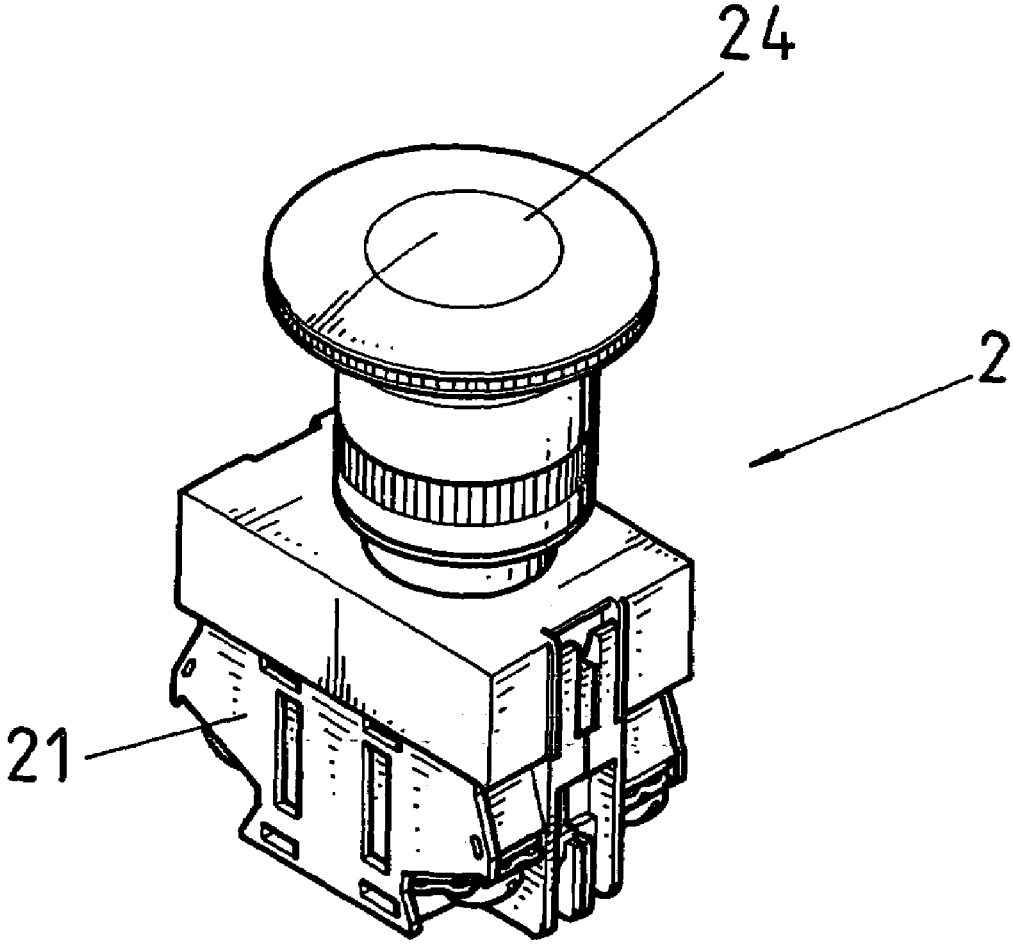
FIG. 2 shows an elevational view of an emergency switch.
Figure 4:
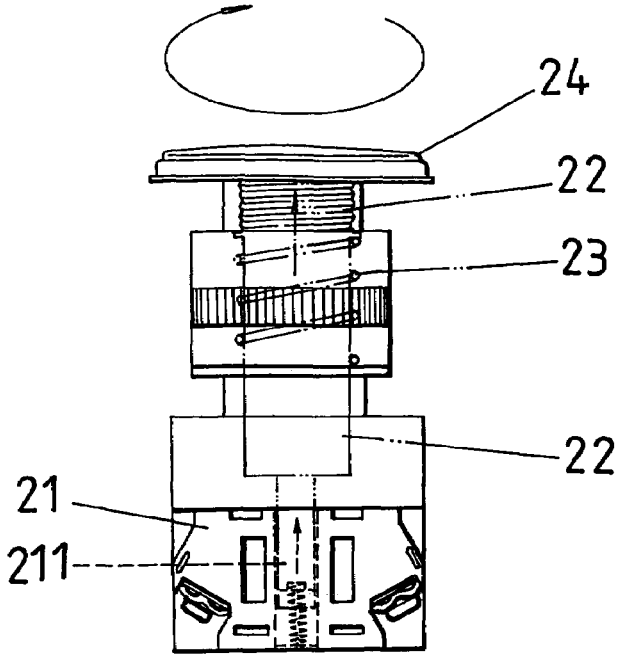
FIG. 4 shows another sectional view of an emergency switch (OFF).
Figure 3:
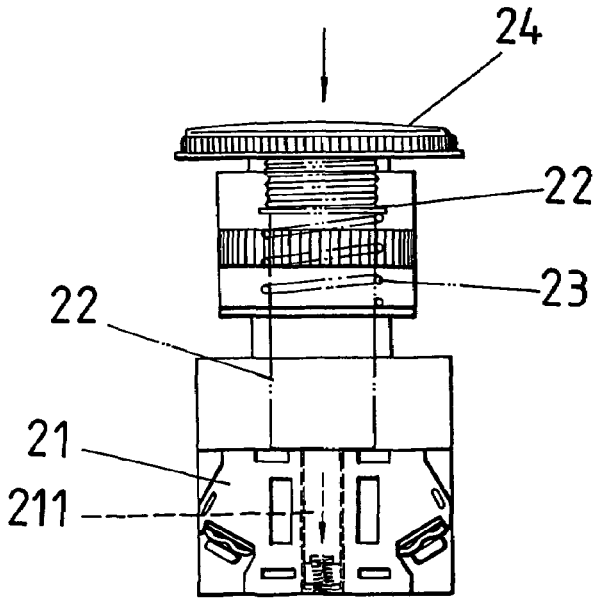
FIG. 3 shows a sectional view of an emergency switch (ON).

As shown in FIG. 1, an emergency switch 2 is installed on a lid 1 of a paper shredder. A paper feeder 11 is on one side of the lid 1, and a warning light 12 is by the emergency switch 2. Referring to FIG. 2, FIG. 3 and FIG. 4, the emergency switch 2 is consisted of a body 21, a shaft 22, twisting spring 23 and a button 24. The body 21 is configured with two insulation blocks 211, and a shaft 22 is connected to the top of the insulation blocks 211. When the button 24 is pressed, the shaft 22 will push the insulation blocks 211 downward as shown in FIG. 3.

Figure 5:
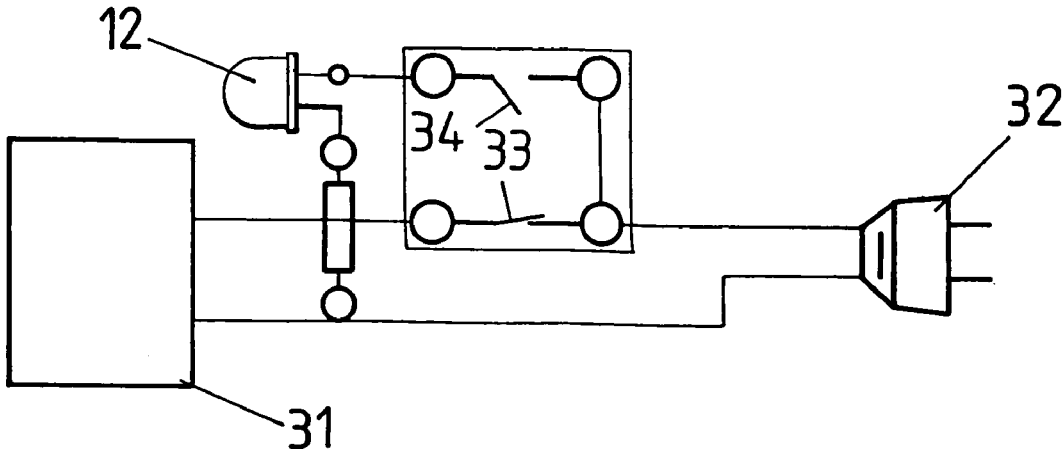
FIG. 5 shows a schematic view of an emergency circuit in the normal mode.
Figure 6:
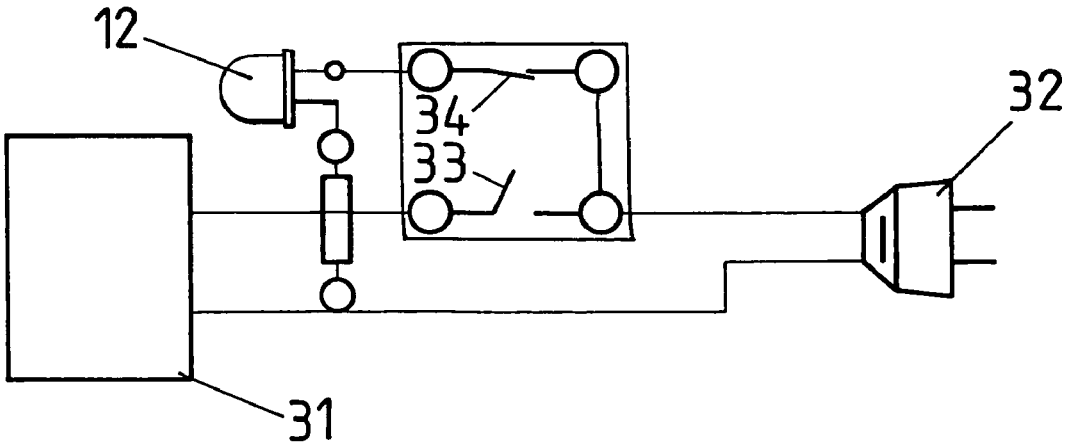
FIG. 6 shows another schematic view of an emergency circuit with the emergency stop engaged.

According to FIG. 5, a schematic view of the circuits inside of a paper shredder, the emergency switch has a double-pole single-throw configuration with a normally-closed contact and a normally-open contact, and a first power conductor 33 between a PC board 31 of a paper shredder drive and an electrical plug 32 is connected through the normally-closed contact under normal operation. Thus, the shredding function is enabled. A warning light 12 is connected to the normally-open contact, in parallel with the paper shredder drive and the normally-closed contact. Since a second power conductor 34 between the warning light 12 and the electrical plug 32 is disconnected in the normal mode, the warning light 12 does not shine. Referring to FIG. 3 and FIG. 6, the insulation blocks 211 of the emergency switch 2 are pressed downward to disconnect the power conductor 33 between the PC board 31 and the electrical plug 32 for broken circuit to temporarily disable shredding function of the paper shredder. Meanwhile, the power conductor 34 between the warning light 12 and the electrical plug 32 is connected for the warning light 12 to blink as warning signal.

When the emergency status is relieved, the elasticity of the spring 23 brings the shaft 22 and the button 24 back to normal position by turning the button 24 clockwise as in FIG. 4. Furthermore, the insulation blocks 211 return to upward position. The paper shredder continues to provide paper-shredding function when the power conductor 33 between the PC board 31 and the electrical plug 32 is connected; meanwhile, the power conductor 34 between the warning light 12 and the electrical plug 32 is disconnected.

What is claimed is:

1. An emergency stopping safety device of a paper shredder comprising:

an emergency switch, configured on a lid of the paper shredder, having a double-pole single-throw configuration, with one normally-closed contact electrically connecting a paper shredder drive to a first power conductor of an electrical plug, and one normally-open contact connected to said first power conductor of said electrical plug;

a warning light, configured on a lid of the paper shredder near said emergency switch, electrically connected between a second power conductor of said electrical plug and said normally-open contact of said emergency switch; and an emergency electrical circuit with said warning light and said normally-open contact being connected in parallel to said paper shredder drive and said normally closed contact of said emergency switch;

wherein said emergency switch temporarily disables the paper shredder by disconnecting a power conductor between the paper shredder drive and an electrical plug when pressed in emergencies, and said warning light provides a warning signal when the paper shredder is disabled.

2. The emergency stopping safety device of a paper shredder in accordance with claim 1 wherein, the emergency switch further comprising:

a body which is configured with insulation blocks;

a shaft connected to the top of the insulation blocks of the body that can push the insulation blocks downward to disconnect the circuit of the PC board of the paper shredder;

a button that temporarily disables the paper shredding function of the paper shredder when being pressed; and a spring that brings the shaft, the button and the insulation blocks back to normal position with its elasticity when the emergency is relieved.

3. The emergency stopping safety device of a paper shredder in accordance with claim 2 wherein, the paper shredder drive can be connected again by turning the button of the emergency switch clockwise, and the elasticity of the spring therein can bring the shaft and the button back to original position; thus, the paper shredder drive returns to connected status.

* * * * *